United States Patent [19]

Davis

[11] 4,312,203

[45] Jan. 26, 1982

[54] FLUSH-MOUNTABLE LOCK WITH ACTUATOR DISCONNECT FEATURE

[75] Inventor: Edwin W. Davis, Medina, Ohio

[73] Assignee: The Eastern Company, Cleveland, Ohio

[21] Appl. No.: 108,011

[22] Filed: Dec. 28, 1979

[51] Int. Cl.[3] ..... E05B 55/10

[52] U.S. Cl. ..... 70/472; 70/149; 70/488; 292/227; 292/DIG. 37

[58] Field of Search ..... 70/472, 488, 489, 149, 70/204, 218, 208, 221-224, 416; 292/167, 173, 223, 226, 227, DIG. 27, DIG. 31, DIG. 37

[56] References Cited

U.S. PATENT DOCUMENTS

| | | |
|---|---|---|
| 269,953 | 1/1883 | Moritz . |
| 528,450 | 10/1894 | Swanberg . |
| 1,751,184 | 3/1930 | Wodarra . |
| 1,785,381 | 12/1930 | Holtzman . |
| 1,840,062 | 1/1932 | Taylor . |
| 1,909,210 | 5/1933 | Miller . |
| 1,911,564 | 5/1933 | Gahagan . |
| 1,960,410 | 5/1933 | Christensen . |
| 1,964,066 | 6/1934 | Kuszmaul . |
| 2,053,805 | 9/1936 | Van Note . |
| 2,075,948 | 4/1937 | Kuszmaul . |
| 2,117,715 | 5/1938 | Godfried . |
| 2,274,455 | 2/1942 | Murphy . |
| 2,322,892 | 6/1943 | Springer . |
| 2,453,505 | 11/1948 | Fornwald . |
| 2,459,029 | 1/1949 | Ingres et al. . |
| 2,468,644 | 4/1949 | Springer . |
| 2,582,928 | 1/1952 | Dall . |
| 2,603,963 | 7/1952 | Allen . |
| 2,629,618 | 2/1953 | Roethel . |
| 2,649,321 | 8/1953 | Smith . |
| 2,658,781 | 11/1953 | Allen . |
| 2,700,290 | 1/1955 | Dall . |
| 2,705,882 | 4/1955 | Craig . |
| 2,705,884 | 4/1955 | Craig . |
| 2,723,145 | 11/1955 | Smith . |
| 2,728,214 | 12/1955 | Craig . |
| 2,759,351 | 8/1956 | Allen ..... 70/149 X |
| 2,772,908 | 12/1956 | Craig . |
| 2,773,716 | 12/1956 | Craig . |
| 2,782,062 | 2/1957 | Smith . |
| 2,877,043 | 3/1959 | Leslie . |
| 2,955,864 | 10/1960 | Van Voorhees . |
| 2,978,895 | 4/1961 | Heisler . |
| 2,987,907 | 6/1961 | Cockburn et al. . |
| 3,007,731 | 11/1961 | Roethel . |
| 3,069,889 | 12/1962 | Johnstone et al. . |
| 3,104,124 | 9/1963 | Beck . |
| 3,121,580 | 2/1964 | Di Salvo et al. . |
| 3,129,026 | 4/1964 | Gergoe et al. . |
| 3,153,551 | 10/1964 | Sandor et al. . |
| 3,171,677 | 3/1965 | Klove, Jr. et al. . |
| 3,309,127 | 3/1967 | Pickles . |
| 3,314,708 | 4/1967 | Welch . |
| 3,386,760 | 6/1968 | Bessette . |
| 3,394,957 | 7/1968 | Foley . |
| 3,423,117 | 1/1969 | Klove, Jr. et al. . |
| 3,587,259 | 6/1971 | Sandor . |
| 3,649,061 | 3/1972 | Meyer . |
| 3,672,713 | 6/1972 | Pickles . |
| 3,679,251 | 7/1972 | Brockman et al. . |
| 3,695,660 | 10/1972 | Fetters . |
| 3,695,663 | 10/1972 | Cockburn . |
| 3,697,105 | 10/1972 | Marx . |
| 3,919,866 | 11/1975 | Lipschutz ..... 70/149 |
| 4,073,170 | 2/1978 | Miyabayashi et al. ... 292/DIG. 37 X |
| 4,116,027 | 9/1978 | Tannery . |
| 4,170,119 | 10/1979 | Kalis, Jr. . |

FOREIGN PATENT DOCUMENTS

| | | |
|---|---|---|
| 135399 | 9/1947 | Australia . |
| 717308 | 2/1942 | Fed. Rep. of Germany . |

*Primary Examiner*—William E. Lyddane

*Attorney, Agent, or Firm*—Burge & Porter Co.

[57] ABSTRACT

A door lock has a flush-mountable body. A forwardly facing recess is defined by the body. A push-button actuator for operating the lock is carried by the body and is movable between normal and operating positions. A bolt is carried on the back of the body and is movable between latching and unlatching positions. A key-controlled disconnect linkage is provided for selectively drivingly connecting and disconnecting the actuator and the bolt. The disconnect linkage includes a disconnect member which is moved by a key-operated locking member between connecting and disconnecting positions located, respectively, in and out of the path of travel of a latch bolt operating arm. When the disconnect linkage drivingly connects the actuator and the bolt, movement of the actuator from its normal position to an operating position will cause corresponding unlatching movement of the bolt. When the disconnect linkage disconnects the actuator from the bolt, movement of the actuator is inoperative to cause unlatching movement of the bolt. A feature of the disconnect linkage is that it provides the lock with a "slam" capability, meaning that the bolt can be slammed into latching engagement with a suitably configured strike regardless of whether the disconnect linkage is drivingly connecting or disconnecting the actuator and the bolt.

5 Claims, 7 Drawing Figures

FLUSH-MOUNTABLE LOCK WITH ACTUATOR DISCONNECT FEATURE

CROSS-REFERENCE TO RELATED APPLICATIONS

PADDLE LOCKS WITH DISCONNECT FEATURES, Ser. No. 108,007 filed concurrently hereiwith on Dec. 28, 1979 by John V. Pastva, Jr., hereinafter "Disconnect Case I."

PADDLE LOCK WITH PIVOTALLY MOUNTED HANDLE DISCONNECT MEMBER, Ser. No. 108,010 filed concurrently herewith on Dec. 28, 1979 by Albert L. Pelcin, hereinafter "Disconnect Case II."

PADDLE LOCK WITH BOLT-CARRIED HANDLE DISCONNECT MEMBER, Ser. No. 107,859 filed concurrently herewith on Dec. 28, 1979 by John V. Pastva, Jr. and Albert L. Pelcin, hereinafter "Disconnect Case III."

PADDLE LOCK WITH ROTATABLY-MOUNTED HANDLE DISCONNECT MEMBER, Ser. No. 108,017 filed concurrently herewith on Dec. 28, 1979 by James A. Reed and Edwin W. Davis, hereinafter "Disconnect Case IV."

PADDLE LOCK WITH TRANSLATABLY-MOUNTED HANDLE DISCONNECT MEMBER, Ser. No. 108,015 filed concurrently herewith on Dec. 28, 1979 by Edwin W. Davis, hereinafter "Disconnect Case V."

PADDLE LOCK WITH HANDLE DISCONNECT, Ser. No. 108,016 filed concurrently herewith on Dec. 28, 1979 by Jye P. Swan, John V. Pastva, Jr. and Donald J. Dignan, hereinafter "Disconnect Case VI."

PADDLE LOCK WITH GUARD-PROTECTED HANDLE DISCONNECT MEMBER, Ser. No. 107,858 filed concurrently herewith on Dec. 28, 1979 by Edwin W. Davis, hereinafter "Disconnect Case VII".

The present application and the applications cross-referenced above have been assigned to a common entity, The Eastern Company, a corporation of Connecticut.

BACKGROUND OF THE INVENTION

1. Field of the Invention

The present invention relates generally to a door lock having a latch bolt which is movable between latching and unlatching positions, an actuator for unlatching the bolt, and a key control for selectively permitting and preventing the actuator from unlatching the bolt. More particularly, the invention relates to a lock of this type including a key-controlled disconnect linkage for selectively drivingly connecting and disconnecting the actuator and the bolt, whereby the actuator is, at all times, freely movable between normal and operating positions, but is functional only when the key control is "unlocked" to enable the actuator to unlatch the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt movably carried on the body, and an operating handle for moving the bolt relative to the body are well known. Normally the handle is in a flush or nested position when the bolt is latched. Bolt unlatching is effected by moving the handle to an operating position. Locks of this type are well suited for use on swinging doors of vehicles such as trucks, or merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in U.S. Pat. No. De. 230,132 issued Jan. 29, 1974 to John V. Pastva, Jr.

The provision of an actuator disconnect feature in a door lock is desirable in that the presence of such a feature will lessen, if not totally eliminate, incidents of these locks being damaged by would-be intruders. The actuators of most previously proposed door locks take the form of handles which are restrained from moving when the locks are locked. It is common for would-be intruders to attempt to defeat locks of the type having handles which are restrained from moving when the locks are locked, by applying excessive leverage force to the lock handles. Where handle disconnect features are provided, the lock handles may always be moved freely, but are functional to retract the lock bolts only when the locks are "unlocked." Locks having actuator disconnect features of this type can be made practically entry-proof short of the application of such forces as will totally destroy the locks.

Door locks employing various types of actuator disconnect systems have been proposed. Prior proposals have, however, suffered from a variety of drawbacks including complexities of construction and failures to mount all of the operating parts of a lock on a single body member so that the resulting lock forms a compact, easy to install unit.

3. The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by coworkers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these cases include claims of identical scope.

SUMMARY OF THE INVENTION

The present invention overcomes the foregoing and other drawbacks of the prior proposals by providing a novel and improved, reliable and durable, actuator-operated door lock capable of providing relatively maintenance-free service. A simple but sturdy key-controlled disconnect linkage is provided for selectively drivingly connected and disconnecting the actuator and latch bolt of the lock.

A door lock embodying principles of the present invention preferably includes a support structure or body having front and back wall surfaces. A latch bolt is movably supported on the body at a location behind the back wall. The bolt is movable between latching and unlatching positions with respect to the body. An actuator is supported on the body for movement between normal and operating positions.

A key-controlled disconnect linkage has a locking member which is movable between locked and unlocked positions. A disconnect member is moved by the locking member between connecting and disconnecting positions wherein the disconnect member selectively drivingly connects and disconnects the actuator and the latch bolt. When the locking member is in its locked position, the disconnect member disconnects the actuator and the bolt such that movement of the actuator will cause no corresponding movement of the bolt. When the locking member is in its unlocked position, the disconnect member is operable to drivingly connect the actuator and the bolt such that, when the actuator is moved out of its normal position to an operating position, the bolt is unlatched.

A further feature of locks embodying the preferred practice of the present invention is that they have "slam" capabilities, meaning that their latch bolts may be slammed into latching engagement with suitably configured strikes regardless of whether the locking members of the locks are "locked" or "unlocked."

The disconnect linkage includes several improvements over previously proposed actuator disconnect systems. The disconnect member is mounted on the back of the lock body and is therefore shielded by the lock body from access by would-be intruders. The disconnect member is mounted for movement between connecting and disconnecting positions located, respectively, in and out of the path of travel of a latch bolt operating arm. When the disconnect member is in its connecting position, it is positioned in the path of atravel of the operating arm to provide a driving connection between the actuator and the latch bolt. When the disconnect member is in its disconnecting position, it is positioned out of the path of travel of the operating arm and provides no driving connection between the actuator and the latch bolt.

As will be apparent from the foregoing summary, a feature of the present invention lies in the provision of a novel and improved door lock with a key-controlled disconnect system for selectively drivingly connecting and disconnecting an operating actuator and a latch bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
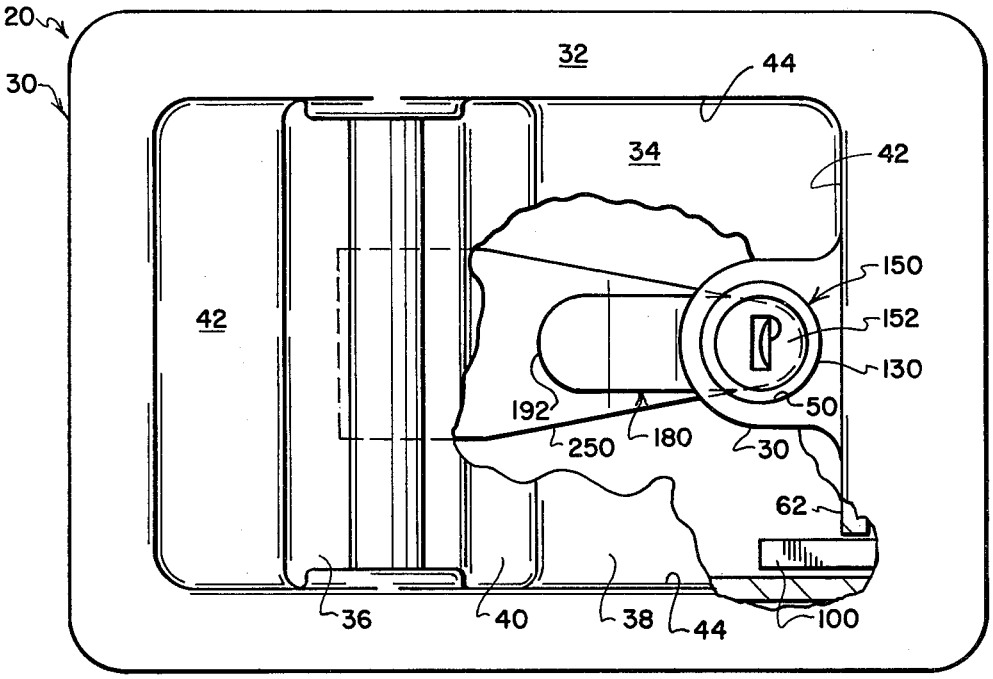
FIG. 1 is a front side elevational view of a lock incorporating features of the present invention, with portions broken away to permit underlying components to be viewed, with the components of the lock being positioned in a locked attitude, with the actuator in its normal position, and with portions of the lock housing being broken away to permit underlying components to be viewed.

Referring to FIGS. 1–7, a key-controlled, actuator-operated, flush-mountable lock embodying the preferred practice of the present invention is indicated generally by the numeral 20. The lock 20 is adapted to be supported on such structures as a swinging door (not shown) for relative movement therewith to bring the lock 20 into and out of juxtaposition with a cylindrical strike, indicated generally by the numeral 22 in FIGS. 2–7. The strike 22 typically is supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a latch bolt assembly 60 carried on the rear side of the body 30. A latch bolt 90 forms a part of the latch bolt assembly 60 and is movable between latching and unlatching positions. An operating lever 100 and an integrally formed pawl 86 forms parts of the latch bolt assembly 60 and are operable to selectively retain the latch bolt 90 in its latching position and to release the latch bolt 90 for movement toward its unlatching position. A torsion coil spring 110 biases the bolt 90 toward its unlatching position. An actuator button 130 is movably carried on the body 30 for movement between normal and operating positions. A key control 150 and a disconnect member 180 are provided for selectively drivingly connecting and disconnecting the actuator button 130 and the latch bolt 90. An actuator return spring 250 biases the actuator button 130 toward its normal position.

The body 30 is a rectangular, die-cast metal member having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. End walls 42 and side walls 44 connect the back wall portions 36, 38, 40 with the flange 32.

Other features of the body 30 include an actuating member mounting hole 50 formed through the body 30, and three mounting bosses 52 which project rearwardly from the body 30. Additionally, a pair of spaced, rearwardly-extending mounting flanges 62, 66 are provided toward the right side of the body 30, as viewed in FIG. 2. The flange 66 is notched, as indicated by the numeral 68, to receive the strike 22. A stop pin 77 extends through aligned holes formed through the flanges 62, 66 and overlies a portion of the bolt 90.

Figure 4:
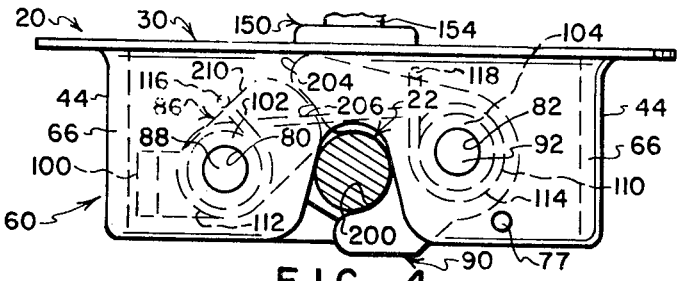
FIG. 4 is an elevational view of the lock of FIG. 1 with components of the lock positioned as shown in FIG. 2.
Figure 7:
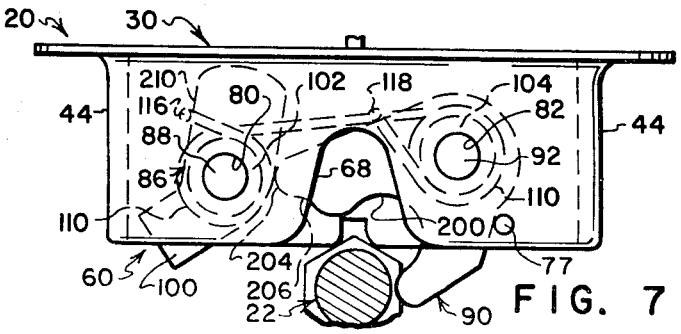

Two sets of aligned holes 80, 82 are formed through the parallel extending flanges 62, 66, as best seen in FIGS. 4 and 7. A pawl member 86 is carried betwen the flanges 62, 66 in the vicinity of the first set of holes 80. A pin 88 extends through the first set of holes 80 and through the pawl member 86 to rotatably mount the pawl member 86 on the body 30. The bolt member 90 is carried between the flanges 62, 66 at a location adjacent the second set of holes 82. A pin 92 extends through the second set of holes 82 and through the bolt 90 to rotatably mount the bolt 90 on the body 30.

As is best seen in FIG. 4, bushings 102, 104 are carried on the pins 88, 92 and extend between the flange 62 and the pawl and latch bolt members 86, 90, respectively. The torsion coil spring 110 has coiled portions 112, 114 reeved around the bushings 102, 104, and has end portions 116, 118 which engage the pawl and latch bolt members 86, 90. Referring to FIG. 4, the torsion coil spring 110 biases the pawl member 86 in a clockwise direction, and biases the bolt member 90 in a counterclockwise direction.

The latch bolt 90 has a U-shaped receiving slot 200 which is configrured to receive the strike 22. The latch bolt 90 has a complexly configured perimeter which includes nose and contact portions 204, 206 which are selectively engageable with the pawl member 86. The spring end 118 engages a side surface of the latch bolt 90. The pawl member 86 has a projecting lug 210 which is selectively engageable with the nose and contact portions 204, 206. The spring end 116 engages a side surface of the lug 210. The operating lever 100 comprises an L-shaped projection formed as an integral part of the pawl member 86. The operating lever 100 extends to a position where it is engageable by the disconnect member 80 when the disconnect member 80 is in its operating position.

Figure 5:
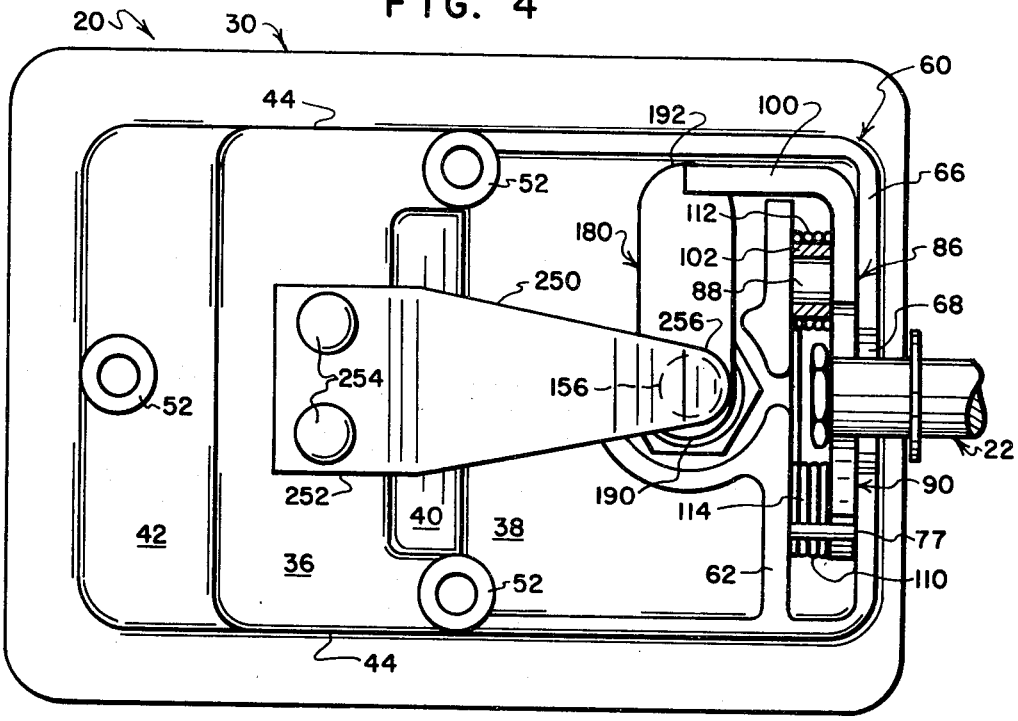
FIG. 5 is a rear side elevational view similar to FIG. 2 with the components of the lock being positioned in an unlocked attitude, with the actuator having been moved to its operating position, and with the bolt having been moved to its unlatched position wherein it discharges and no longer engages the strike.
Figure 6:
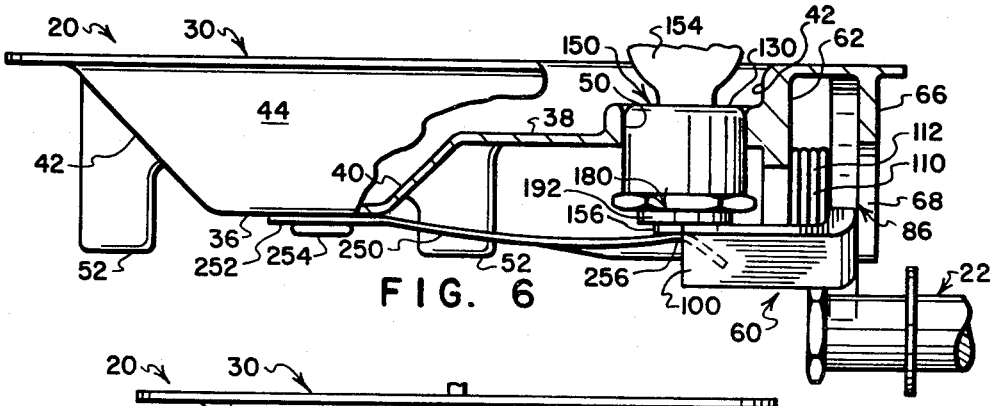
FIG. 6 is a bottom plan view similar to FIG. 3 with portions broken away to permit underlying components to be viewed, the components of the lock being positioned as shown in FIG. 5; and, FIG. 7 is an end elevational view of the lock of FIG. 1 with the components of the lock being positioned as shown in FIG. 5.

In FIGS. 5–7, the latch bolt 90 and the pawl 86 are shown positioned in their unlatching attitude. When unlatched, the bolt 90 is pivoted counterclockwise by the spring 110 to a position where the U-shaped receiving slot 200 opens downwardly to receive or discharge the strike 22. In this attitude, the pawl lug 210 engages the nose surface 204 of the latch bolt member 90.

Figure 2:
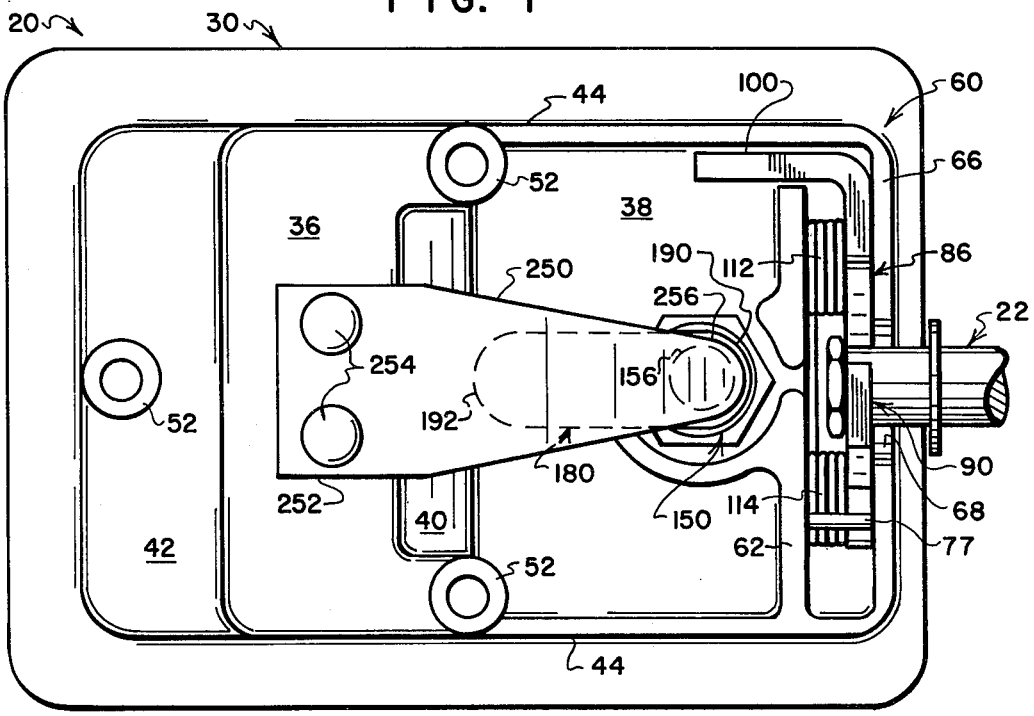
FIG. 2 is a rear side elevational view of the lock of FIG. 1 with the components of the lock positioned as shown in FIG. 1, and with the lock bolt in its latched position engaging a strike.
Figure 3:
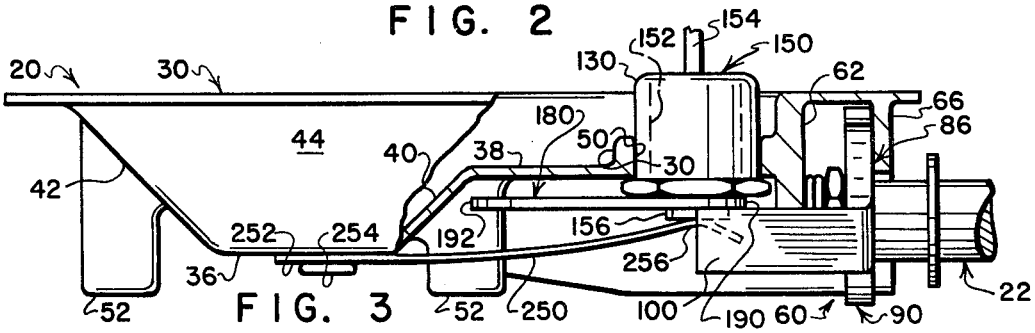
FIG. 3 is a bottom plan view of the lock of FIG. 1 with the components of the lock positioned as shown in FIG. 2, and with portions of the lock housing being broken away to permit underlying components to be viewed.

As the strike 22 moves into receiving engagement with the latch bolt receiving slot 200, as shown in FIGS. 2–4, the strike 22 causes the latch bolt 90 to rotate clockwise in opposition to the action of the spring 110. Once the nose portion 204 has moved out of the way of the pawl lug 210, the spring 110 causes the pawl member 86 to rotate clockwise to a position where the pawl lug 210 engages the contact surface 206 of the latch bolt 90. When the pawl member 86 engages the surface 206, the latch bolt 90 is prevented from rotating counterclockwise, and the strike 22 is thereby retained in by the latch bolt assembly 60.

In order to release the strike 22 from the latch bolt assembly 60, the operating lever 100 is moved to rotate the pawl member 86 counterclockwise in opposition to the spring 110. As the pawl 86 rotates counterclockwise, the lug 210 disengages the bolt contact surface 206, thereby permitting the bolt 90 to pivot to its unlatched position under the influence of the spring 110, whereupon the strike 22 is ejected from engagement with the latch bolt assembly 60, as is shown in FIGS. 5–7.

The actuator button 130 is slidably carried in the hole 50 formed through the body 30. The button 130 is movable between a normal position, as best seen in FIG. 3, and an operating position, as best seen in FIG. 6. The actuator return spring 250 is a leaf spring which has one end region 252 connected to the rear wall of the body 30 by rivets 254, and a distal end region 256 which biases the actuator button 130 toward its normal position.

When the actuator button 130 is moved out of its normal position to an operating position by moving it rearwardly into the body hole 50, as viewed in FIG. 6, the disconnect member 180 is moved simultaneously rearwardly in opposition to the action of the spring 250. If the disconnect member 180 is positioned in what will be termed its "connecting" position, as shown in FIGS. 5 and 6, it is engageable with the operating arm 100 to provide a driving connection between the actuator button 130 and the latch bolt 90. When the disconnect member 180 is in its connecting position, the pawl member 86 is caused to pivot counterclockwise to release the latch bolt 90, as viewed in FIGS. 6 and 7, in response to movement of the actuator button 130 to its operating position. In FIGS. 1–3, the disconnect member 180 is shown in its "disconnecting" position wherein it provides no driving connection between the actuator button 130 and the operating arm 100. When the disconnect member 180 is in its disconnecting position, rearward movement of the actuator buttom 130 to its operating position will cause no corresponding movement of the latch bolt operating level 100.

The key control 150 includes a lock cylinder 152 into which a key 154 may be inserted. The key 154 is configured to cooperate with tumblers (not shown) housed within the cylinder 152 to permit a locking member 156 to be rotated between locked and unlocked positions. The locking member 156 carries the disconnect member 180 and is engaged by the distal end 256 of the actuator return spring 250. The disconnect member 180 is an elongate, flat member connected rigidly at one end 190 to the locking member 156, and having a rounded distal end 192. The locking member 156 is unlocked when the disconnect member 180 is in its connecting position, as shown in FIGS. 5–7, and is locked when the disconnect member 180 is in its disconnecting position, as shown in FIGS. 2 and 3.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

When the locking member 156 is in its unlocked position as shown in FIGS. 5–7, the locking member 156 positions the disconnect member 180 in its connecting position where, as is best seen in FIG. 5, the distal end 192 is positioned within the path of travel of the operating lever 100 and thereby provides a driving connection between the actuator button 130 and the latch bolt 90. When the disconnect member 180 is in its connecting position, rearward movement of the actuator button 130 from its normal position, shown in FIG. 3, to its operating position, shown in FIG. 6, will cause the disconnect member 180 to move rearwardly, pivoting the operating arm 100 amd the pawl 86 to release or unlatch the latch bolt 90.

When the locking member 156 is in its locked position, as shown in FIGS. 2 and 3, the disconnect member 180 is pivoted to its disconnecting position where the distal end 192 is positioned out of the path of travel of the operating lever 100 and no driving connection is provided between the disconnect member 180 and the operating arm 100. When the disconnect member 180 is in its disconnecting position, rearward movement of the actuator button 130 from its normal position to its operating position will cause no unlatching movement of the operating lever 100. Under these circumstances, the actuator button 130 can be moved freely without causing any corresponding unlatching movement of the bolt 90.

As will be apparent from the foregoing description, a feature of the present invention lies in the provision of door locks which are particularly well suited for use on pivoted closures. Locks embodying the preferred practice of the present invention feature flexibility of installation and reliability of operation. The locks are formed from simple and inexpensive-to-manufacture components, and are of sturdy construction.

A feature of locks embodying the present invention is that their actuators are free to move at all times, but are only operable to release their latch bolts when their key controls are positioned in "unlocked" attitudes. The described lock embodiment has a "slam" capability enabling its latch bolt to be moved into latching engagement with a suitably configured strike regardless of whether the lock is "locked" or "unlocked." Moreover, if the latch bolt of the lock is slammed into engagement with a suitably configured stroke, the latch bolt will move to latchingly engage the strike without causing corresponding movement of the actuator.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable door lock, comprising:

(a) a body structure having side and back walls which cooperate to define a forwardly-facing recess, and having an opening formed through the back wall;

(b) a bolt structure supported on the body structure at a location behind a portion of the back all, the bolt structure being movable between a latching and an unlatching position;

(c) a push button actuator mounted on the body structutre and being movable along a linear path of travel extending through the back wall opening between normal and operating positions;

(d) connecting means carried by the actuator for selectively drivingly connecting and disconnecting the actuator and bolt structures, the connecting means being movable between a connecting position wherein it is operable to provide a driving connection between the actuator and bolt structures such that, when the actuator structure is moved out of its normal position, the bolt structure is caused to move to its unlatching position, and a disconnecting position wherein no driving connection is provided between the actuator and bolt structures whereby, when the actuator structure is moved with respect to the body structure, no corresponding movement of the bolt structure is effected;

(e) key control means carried by the actuator and being operable to move the connecting means between its connecting and disconnecting positions;

(f) leaf spring means including an elongate leaf spring having a first portion secured to the body structure and having a second portion overlying the actuator for biasing the actuator toward its normal position, the body structure and the leaf spring having overlying portions defining a space therebetween; and, (g) the connecting means being configured to extend between the overlying portions of the body structure and the leaf spring when the connecting means is in its disconnecting position.

2. The door lock of claim 1 wherein the body structure is of generally rectangular configuration having a length which is longer than its width, and wherein the leaf spring is arranged relative to the length of the body structure such that the length of the elongate leaf spring parallels the length of the body structure, whereby the overlying portions of the body structure and of the leaf spring define a longitudinally extending space therebetween wherein the connecting means resides while in its disconnecting position.

3. The door lock of claim 2 wherein the connecting means includes an elongate arm which, when in its disconnecting position, extends in said space in a direction paralleling the length of the body structure.

4. The door lock of claim 1 wherein the body structure comprises a cast member having wall portions including a back wall which defines a forwardly facing recess having regions of different depths, with a first back wall portion defining a relatively shallow recess region, and a second back wall portion defining a relatively deep recess regions.

5. The door lock of claim 4, wherein the leaf spring is connected to the second back wall portion and overlies the first back wall portion to define said space therebetween.

* * * * *

UNITED STATES PATENT AND TRADEMARK OFFICE

CERTIFICATE OF CORRECTION

PATENT NO. : 4,312,203

DATED : January 26, 1982

INVENTOR(S) : Edwin W. Davis

It is certified that error appears in the above-identified patent and that said Letters Patent are hereby corrected as shown below:

Col. 1, line 8, delete "hereiwith" and substitute --herewith--

Col. 2, line 4, delete "or" and substitute --on--

Col. 3, line 46, delete "atravel" and substitute --travel--

Col. 4, line 13, after "an" insert --end--

Col. 5, line 38, delete "configrured" and substitute --configured--.

Col. 6, line 41, delete "buttom" and substitute --button--

Col. 7, line 16, delete "amd" amd substitute --and--

Col. 7, line 50, delete "stroke" and substitute --strike--

Col. 8, line 5, delete "all" and substitute --wall--

Col. 8, lines 8 and 9, delete "structutre" and substitute --structure--

Signed and Sealed this

*Twenty-ninth* Day of *June 1982*

[SEAL]

*Attest:*

GERALD J. MOSSINGHOFF

*Attesting Officer*

*Commissioner of Patents and Trademarks*